US009474685B2

(12) United States Patent
Thierman

(10) Patent No.: US 9,474,685 B2
(45) Date of Patent: Oct. 25, 2016

(54) APPARATUS FOR LOCALIZED DERMATOLOGICAL TREATMENT

(71) Applicant: Sure-Shot Medical Device Inc., Las Vegas, NV (US)

(72) Inventor: Jonathan Thierman, Baltimore, MD (US)

( * ) Notice: Subject to any disclaimer, the term of this patent is extended or adjusted under 35 U.S.C. 154(b) by 783 days.

(21) Appl. No.: 13/630,372

(22) Filed: Sep. 28, 2012

(65) Prior Publication Data

US 2013/0079689 A1 Mar. 28, 2013

Related U.S. Application Data

(60) Provisional application No. 61/540,147, filed on Sep. 28, 2011.

(51) Int. Cl.
*A61H 7/00* (2006.01)
*A61H 23/00* (2006.01)
(Continued)

(52) U.S. Cl.
CPC ..... *A61H 39/08* (2013.01); *A61H 7/00* (2013.01); *A61H 7/002* (2013.01); *A61H 7/004* (2013.01); *A61H 23/00* (2013.01); *A61H 23/006* (2013.01);
(Continued)

(58) Field of Classification Search
CPC ..... A61H 2201/50; A61H 2201/5002; A61H 2201/5005; A61H 2201/5007; A61H 2201/501; A61H 2201/5023; A61H 2201/5043; A61H 2201/5082; A61H 2230/00; A61H 2230/04; A61H 2230/045; A61H 2230/08; A61H 2230/085; A61H 23/00; A61H 2023/002; A61H 23/004; A61H 23/006; A61H 23/02; A61H 23/0245; A61H 2201/12; A61H 2201/1207; A61H 2201/16; A61H 2201/165; A61H 2201/1654; A61H 2201/169; A61H 2201/1692; A61H 2201/1695; A61H 39/08; A61H 7/002; A61H 7/003; A61H 7/004; A61H 7/005; A61H 2201/5097; A61H 2230/065; A61H 2230/305; A61H 2201/5038; A61H 2230/208
USPC ..... 604/289, 290; 606/131
See application file for complete search history.

(56) References Cited

U.S. PATENT DOCUMENTS 1,896,351 A * 2/1933 Doran ..... A61H 23/0254 601/74
2,703,571 A * 3/1955 Thomas ..... A61H 23/0263 601/74
(Continued)

FOREIGN PATENT DOCUMENTS

CN 203169818 U 9/2013
CN 203379477 U 1/2014
(Continued)

OTHER PUBLICATIONS

R. Connery, "Ultrasound Scar Removal", eHow, Date Unknown.
Huang et al., "Pressure therapy upregulates matrix metalloproteinase expression and downregulates collagen expression in hypertrophic scar tissue", Chin. Med. J., 2013, p. 3321-3324, vol. 126, issue 17.
(Continued)

*Primary Examiner* — Justine Yu
*Assistant Examiner* — Tu Vo
(74) *Attorney, Agent, or Firm* — Intrinsic Law Corp.; Ibrahim M. Hallaj

(57) ABSTRACT

An apparatus provides controlled vibratory stimulation to skin at an area suffering from a condition, for example scarred tissue locations. The vibratory action and other action of agents used in conjunction with the apparatus permit revision of scars and general treatment of skin conditions and improved or accelerated healing thereof.

12 Claims, 5 Drawing Sheets

(51) Int. Cl.

| | |
|---|---|
| ***A61H 23/02*** | (2006.01) |
| ***A61H 39/08*** | (2006.01) |
| *A61H 15/00* | (2006.01) |

(52) U.S. Cl.

CPC ..... *A61H 23/02* (2013.01); *A61H 23/0245* (2013.01); *A61H 2015/0014* (2013.01); *A61H 2201/12* (2013.01); *A61H 2201/1207* (2013.01); *A61H 2201/165* (2013.01); *A61H 2201/1695* (2013.01); *A61H 2201/50* (2013.01); *A61H 2201/5038* (2013.01); *A61H 2201/5082* (2013.01); *A61H 2201/5097* (2013.01); *A61H 2230/00* (2013.01); *A61H 2230/065* (2013.01); *A61H 2230/208* (2013.01); *A61H 2230/505* (2013.01)

(56) References Cited

U.S. PATENT DOCUMENTS

| | | | | |
|---|---|---|---|---|
| 4,372,296 | A | 2/1983 | Fahim | |
| 4,732,140 | A * | 3/1988 | Stoffregen | 601/71 |
| 4,887,594 | A * | 12/1989 | Siegel | 601/71 |
| 5,334,131 | A * | 8/1994 | Omandam et al. | 601/71 |
| 5,741,509 | A | 4/1998 | Kushner | |
| 5,902,256 | A * | 5/1999 | Benaron | 601/15 |
| 6,024,717 | A * | 2/2000 | Ball | A61M 37/0092 604/22 |
| 6,030,374 | A * | 2/2000 | McDaniel | A61M 31/002 604/22 |
| 6,322,532 | B1 * | 11/2001 | D'Sa | A61K 41/0047 604/22 |
| 6,534,693 | B2 | 3/2003 | Fischell et al. | |
| 6,629,983 | B1 * | 10/2003 | Ignon | A61B 17/54 606/131 |
| 6,656,147 | B1 * | 12/2003 | Gertsek | A61M 5/14248 604/185 |
| 7,179,152 | B1 * | 2/2007 | Rhoades | 451/41 |
| 7,182,739 | B2 * | 2/2007 | Kopanic et al. | 601/15 |
| 7,628,764 | B2 | 12/2009 | Duarte et al. | |
| 8,014,855 | B2 * | 9/2011 | Marchitto et al. | 604/20 |
| 8,226,662 | B2 * | 7/2012 | Song | A61B 17/54 132/76.4 |
| 8,376,984 | B2 | 2/2013 | James | |
| 8,500,754 | B2 * | 8/2013 | Hull, Jr. | A45D 34/04 606/131 |
| 2002/0099356 | A1 * | 7/2002 | Unger | A61M 25/104 604/501 |
| 2003/0212350 | A1 | 11/2003 | Tadlock | |
| 2003/0220556 | A1 * | 11/2003 | Porat et al. | 600/407 |
| 2004/0024348 | A1 * | 2/2004 | Redding, Jr. | A61K 9/0009 604/22 |
| 2004/0236269 | A1 * | 11/2004 | Marchitto et al. | 604/22 |
| 2004/0236291 | A1 * | 11/2004 | Zelickson | A45D 26/0004 604/289 |
| 2004/0249320 | A1 * | 12/2004 | Yamazaki | A45D 34/042 601/46 |
| 2005/0142093 | A1 * | 6/2005 | Skover et al. | 424/70.14 |
| 2006/0010625 | A1 * | 1/2006 | Tapper | A61H 7/005 15/97.1 |
| 2006/0110415 | A1 | 5/2006 | Gupta | |
| 2006/0149169 | A1 * | 7/2006 | Nunomura et al. | 601/2 |
| 2007/0225732 | A1 * | 9/2007 | Cho | A61B 17/54 606/131 |
| 2008/0058648 | A1 | 3/2008 | Novak et al. | |
| 2008/0071203 | A1 | 3/2008 | Miller | |
| 2008/0167601 | A1 * | 7/2008 | Laermer | A61B 17/205 604/22 |
| 2008/0183144 | A1 * | 7/2008 | Trautman | A61M 37/0015 604/272 |
| 2008/0249460 | A1 * | 10/2008 | Skinner | A61B 17/320068 604/22 |
| 2009/0042970 | A1 * | 2/2009 | Herschkowitz | A61M 37/0015 514/423 |
| 2009/0099502 | A1 * | 4/2009 | Tokumoto | A61B 17/205 604/21 |
| 2009/0118662 | A1 * | 5/2009 | Schnall | A61M 37/0015 604/20 |
| 2009/0259168 | A1 | 10/2009 | Prizant | |
| 2009/0299237 | A1 * | 12/2009 | Rhoades | A45D 34/041 601/46 |
| 2010/0168626 | A1 * | 7/2010 | Gubernick | A45D 34/04 601/85 |
| 2010/0198119 | A1 * | 8/2010 | Gubernick | A45D 34/04 601/69 |
| 2010/0217357 | A1 * | 8/2010 | Da Silva et al. | 607/88 |
| 2011/0230817 | A1 | 9/2011 | Moy | |
| 2011/0230870 | A1 | 9/2011 | Moy | |
| 2013/0012858 | A1 | 1/2013 | Jackson et al. | |
| 2013/0060166 | A1 | 3/2013 | Friedman et al. | |

FOREIGN PATENT DOCUMENTS

| | | | |
|---|---|---|---|
| EP | 0651628 | B1 | 5/1995 |
| EP | 1448263 | B1 | 1/2009 |
| WO | WO9304691 | | 3/1993 |
| WO | WO03086535 | A1 | 10/2003 |
| WO | WO2006040597 | A1 | 4/2006 |
| WO | WO2007139812 | A2 | 12/2007 |
| WO | WO2011006100 | A1 | 1/2011 |
| WO | WO2011116135 | A1 | 9/2011 |

OTHER PUBLICATIONS

Tan et al., "Effects of pressure therapy on the proliferation and apoptosis of cells in hypertrophic scar of burn patients", Zhonghua Shao Shang Za Zhi, 2013, p. 509-515, vol. 26, issue 6.

Li et al, "Detection of changes of scar thickness under mechanical loading using ultrasonic measurement", Burns, Feb. 2013, p. 89-97, vol. 39, issue 1.

Van Der Veer et al., "Potential cellular and molecular causes of hypertrophic scar formation", Burns, Feb. 2009, p. 15-29, vol. 35, issue 1.

Costa et al, "Mechanical Forces Induce Scar Remodeling: Study in Non-Pressure-Treated versus Pressure-Treated Hypertrophic Scars", The American Journal of Pathology, Nov. 1999, p. 1671-1679, vol. 155, issue 5.

Gurtner et al., "Improving Cutaneous Scar Formation by Controlling the Mechanical Environment: Large Animal and Phase I Studies", Annals of Surgery, Aug. 2011, p. 217-225, vol. 254, issue 2.

Junker et al., "Assessing quality of healing in skin: Review of available methods and devices", Wound Repair and Regeneration, May 2014, p. 2-10, vol. 22, issue S1, Wound Healing Society.

Kwan et al., "Scar and Contracture: Biological Principles", Hand Clin., Nov. 2009, p. 511-528, vol. 25, issue 4.

R. Ogawa, "Mechanobiology of scarring", Wound Repair and Regeneration, Sep./Oct. 2011, p. s2-s9, vol. 19, issue S1, Wound Healing Society.

Reno et al., "In vitro mechanical compression induces apoptosis and regulates cytokines release in hypertrophic scars", Wound Repair and Regeneration, Sep. 2003, p. 331-336, vol. 11, issue 5.

Reno et al., "Effects of mechanical compression on hypertrophic scars: prostaglandin E2 release", Burns, May 2001, p. 215-218, vol. 27, issue 3, Elsevier Science Ltd.

Van Den Helder et al., "Sense and Nonsense of Scar Creams and Gels", Aesthetic Plastic Surgery, Summer 1994, p. 307-313, vol. 18, issue 3.

A. D. Widgerow, "Cellular/extracellular matrix cross-talk in scar evolution and control", Wound Repair and Regeneration, Mar./Apr. 2011, p. 117-133, vol. 19, issue 2, Wound Healing Society.

A. D. Widgerow, "Current Concepts in Scar Evolution and Control", Aesthetic Plastic Surgery, Aug. 2011, p. 628-635, vol. 35, issue 4, Springer Science & Business Media, LLC and International Society of Aesthetic Plastic Surgery.

Widgerow et al., "New Innovations in Scar Management", Aesthetic Plastic Surgery, May 2000, p. 227-234, vol. 24, issue 3.

* cited by examiner

APPARATUS FOR LOCALIZED DERMATOLOGICAL TREATMENT

RELATED APPLICATIONS

This application is related to and claims the benefit and priority of U.S. Provisional Application 61/540,147, bearing the same title, filed on Sep. 28, 2011, which is, along with the references cited therein, herein incorporated by reference.

TECHNICAL FIELD

The present application relates to dermatological treatments, including the treatment of scars and other skin damage benefiting from surface frictional or vibratory action at a location of said conditions.

BACKGROUND

Various conditions of the skin can be treated by topical action or applications. For example, topically applied compounds, drugs or healing substances can improve an unwanted condition of the skin, reduce its effect, or alleviate the suffering caused by the condition. Examples of conditions of this nature include recovering wounds and cuts, scars, blemishes, acne, and others.

As an example, wounds leave behind scars after the wound heals, scars varying in their degree of visibility depending on several factors. One reason that scars are visible to the eye is that scars may be created in geometrical patterns, such as in straight lines as would happen if a sharp instrument caused the wound that resulted in the scar. Also, when the skin heals following a wound, the formation of the scar may cause contraction or pulling on adjacent areas of skin and this tension in the skin may cause deformation in the adjacent skin or organs, especially if the scar is near a facial organ such as the lips or eye lids. Another reason that scars are visible and considered unsightly is that they may carry a discoloration or a different color from the surrounding skin. Typically, scars may have a pale appearance or may have a reddish or brown colored appearance sometimes known as hyper pigmentation. Hyper pigmentation is sometimes treated with bleaching agents. When a scar causes redness this may sometimes be treated with a laser that softens the appearance of redness. Loss of color or hardening in the scar tissue is sometimes treated using steroid injections to soften the tissue in the vicinity of the scar.

For especially unsightly scars, cosmetic surgery may be applied after the scar is well formed, which is usually six or twelve months following the healing of the wound. An evaluation of the scar is made by a cosmetic surgeon and a variety of surgical techniques may be applied to the scar to mitigate its appears or to reduce the obviousness of the scar to the observers eye. As stated above, since scars are sometimes more visible when they are formed in straight lines that are readily apparent to the observer's eye, surgical techniques may be applied to break up the geometric or straight line configuration of the scar. In one technique a geometric broken line repair is made that causes a previously straight scar to have a more convoluted shape. In other techniques, a procedure known as z-plasty applies small fresh cuts in the vicinity of the scar and rolls them inward to cause an irregular appearance, which is applied in cases of where there is insufficient tissue near the scar to perform a geometric broken line repair. In yet other circumstances, a so-called "running w-plasty" is performed, which is a compromise of the two techniques described above.

For scars that have caused unsightly hard tissue at the surface of the skin, a mechanical dermabrasion or sanding of the scar tissue may be performed to reduce this appearance.

The above cosmetic surgical procedures are generally expensive and only required or appropriate for severe scarring. These procedures generally require the creation of fresh wounds deliberately that cut into the skin so as to create correspondingly newer scars that have a less offensive appearance. Therefore, there are risks and discomfort issues associated with the above techniques that are both expensive painful and inconvenient. Following the above-mentioned surgical procedures, the patient is required to typically wait several months for the surgical cuts and wounds to heal, after which the desired reconfigured scars become apparent and in the best cases outcomes, the new reconfigured scars are less unsightly than the original scar. It can be appreciated that the inconvenience, cost and discomfort, as well as the invasive nature of the above surgical procedures are not ideal or pleasant for the patient that undergoes them.

In other modalities, physical and mechanical stimulation of scar tissue has been found to soften and ameliorate the intensity of the scar in certain patients. As an example, physical therapy including massage and rubbing of the scar tissue and adjacent skin has been found to provide certain benefits to patients with scars. The procedures for reduction of the size or appearance of a scar are generally referred to here in as scar revision. It has also been found that in some situations acoustics may be used, such as by application of ultrasound to scar tissue in order to cause vibratory mechanical treatment of the scar tissue that assists in scar revision. However, the devices and techniques presently employed for scar revision are collectively expensive, inconvenient, uncomfortable, and not as effective as would be desired.

Some existing efforts to apply vibratory action to a skin surface are found in the art. US Pub. No. 2009/0259168 A1, which is directed to a vibrating element in a sticky bandage that is stuck to the skin for application of cosmetic agents or drugs thereto through massaging action of the vibrating element, including battery powered embodiments and embodiments having programmable activation logic. But this reference adheres its bandage (the "sticky bandage" or "SB") to the skin and is not useful for treating conditions that benefit from abrasive action of the applicator or that require relative movement between a surface and the affected skin region.

U.S. Pat. No. 7,628,764 applies a portable ultrasonic source to purportedly heal wounds. The transducer is placed proximal to the wound and emits ultrasonic energy towards the wound as longitudinal or shear waves. The ultrasonic frequency used in this reference is rather high for most applications that benefit from massaging action and the ultrasonic transducer is not configured in the reference to apply relative movement or abrasive action.

U.S. Pat. No. 4,372,296 is directed to a composition that is topically applied to skin for treatment of acne and purportedly speeds the healing of scars through stimulation of the production of collagen and if the composition is sonicated into the affected area using an ultrasonic vibrating element.

US Pub. No. 2008/0058648 A1 is directed to an ultrasonic device for treatment of wounds whereby the device is powered to cause acoustic cavitation in the wound and thereby purportedly increase the delivery of energy to the debrided tissue regions for enhancing healing. This apparatus cannot be applied conveniently or for prolonged periods of time to a patient, and causes effects from the cavitation and ultrasonic energy that are generally not consistent with the action desired in the present application.

US Pub. No. 2003/0212350 is directed to treatment of scar tissue using a suction device that raises the scar tissue so that manual manipulation or sonic vibration can be applied to disrupt the fibrous tissues of the scar. This apparatus like others above is not suited for convenient application to a user's skin and is awkward to use, heavy, and cannot be applied for lengthy time periods. Also, it lacks the desired curative action of the present disclosure as will be clear below.

Accordingly, the present disclosure describes embodiments for an apparatus and a technique for treatment of skin conditions and for accelerating or allowing scar revision using vibratory energy applied at or near the location of a scar.

DETAILED DESCRIPTION

Figure 1:
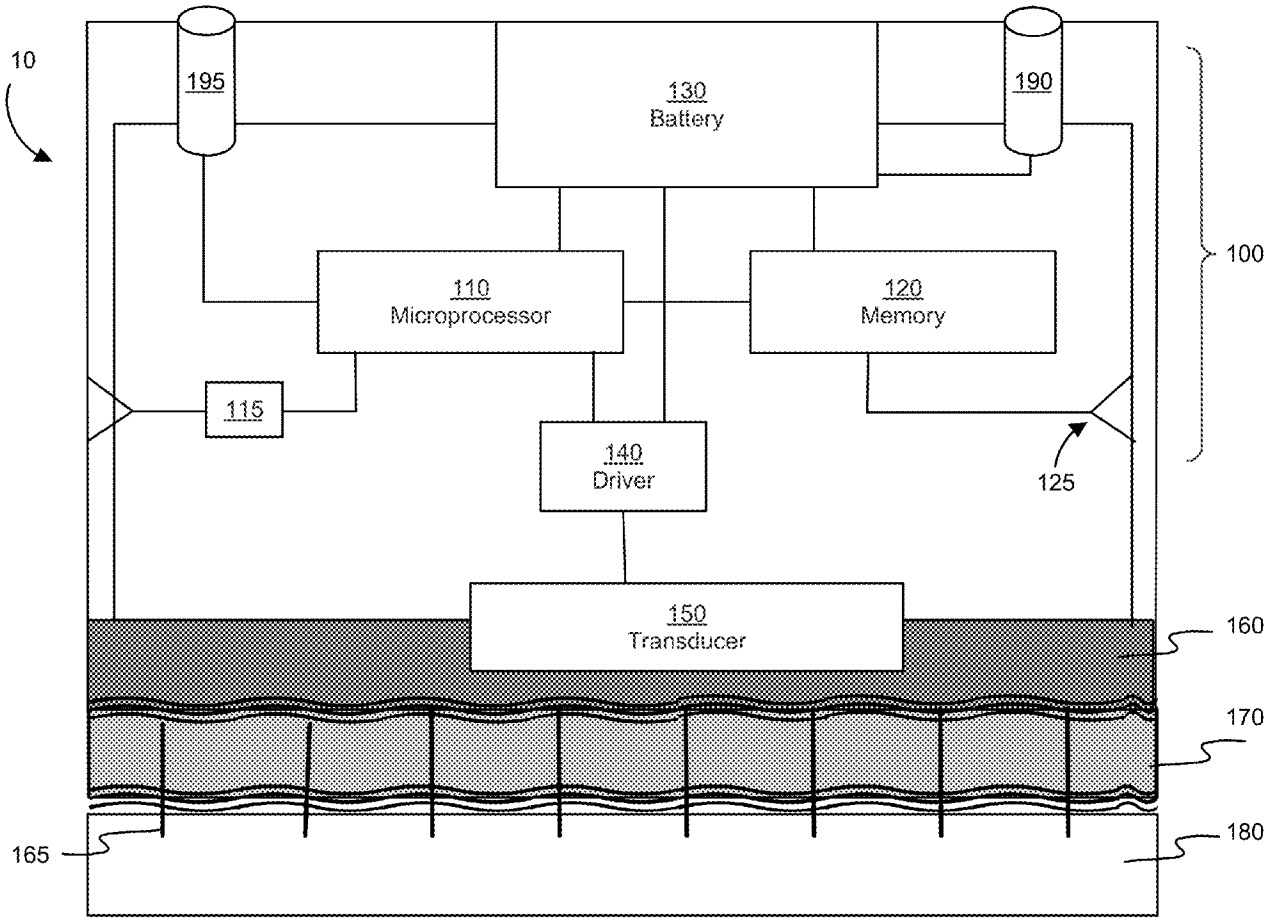
FIG. 1 illustrates an exemplary block diagram of an apparatus for scar revision and other beneficial dermatological effects.

FIG. 1 illustrates an exemplary apparatus 10 for treating wounds and causing or enhancing scar revision. The device of FIG. 1 may preferably be light and small in size so that it can be applied to a location on the skin of a person without difficulty or discomfort. In some embodiments, the device is applied using a sticky substance or adhesive strip or patch so that it adheres to the scarred location of the skin. The device then ameliorates the scar and achieves or assists in scar revision by action as described below.

Generally, the device 10 applies a mechanical vibratory action to a local region of skin tissue proximal to the lower face of the device. The vibratory action assists in scar revision through a number of ways, including by massaging the area to enhance healing blood flow, stimulation of tissue and nerves, mechanical rubbing of the scarred skin, enhancement of the uptake of medicinal agents into the skin, gentle thermal action, or other useful means. The device is battery powered, said battery power providing the energy to drive the vibratory action of the device and also to allow for other electronic functions as will be explained further in the context of the present exemplary embodiments.

The following discussion describes one or more preferred embodiments for the sake of illustration. Alternative embodiments will become apparent to those skilled in the art, and various ways of interconnecting and arranging the elements and components of the device are possible. Some items described herein are optional and do not need to be implemented in every instance, while other optional variations may be added to those presently disclosed without substantially departing from the nature of the invention.

As mentioned previously, the housing 100 of scar revision device 10 is preferably compact and lightweight and contains a number of components. A power source 130 (e.g., a battery) is disposed in a location in the housing 100 that permits replacement of the battery 130. For example, a small battery such as is used in wrist watches, hearing aids, or similar small devices is employed and located below a cover at the upper face of housing 100. The cover and housing may be water resistant or water proof. A first light emitting diode (LED) 190 may be positioned at the upper face of the device to alert to a low-battery condition so that the user may replace the battery for continued operation.

A microprocessor 110 is powered from battery 130 and controls some or all electronic operations of the device. Microprocessor 110 may be an application specific integrated circuit (ASIC) or an off the shelf semiconductor integrated circuit (IC) chip, or other electronic circuit having logic elements to carry out simple tasks. A digital memory device 120 may be coupled to microprocessor 110. The memory 120 can hold program instructions to be executed by the microprocessor 110, and may be programmable in ways known to those skilled in the microprocessor and programming arts. In some embodiments, the device 10 comes preconfigured from the manufacturing source with program instructions residing in memory 120. In other embodiments, memory 120 has program instructions loaded into it that are customized for a particular user of the device. In a specific example, a clinical practitioner can program instructions (by way of an interface 125) to suit the medical needs of the patient. The instructions can be generated automatically by a computer that interfaces with the practitioner using a high-level user interface and then interfaces to device interface 125 through suitable hardware, which can include a wireless data connection.

Memory 120 may include volatile as well as non-volatile sections. Memory 120 may also be used to store operating condition information that can later be uploaded to a computer for review by a practitioner or physician. The operating condition information can be a log of certain parameters sensed by the device or a log of the operating schedule of the device. Microprocessor 110 can retrieve the log of the operating condition information from memory 120 and transmit this to a computer through a wireless or hard wired interface 115. In some cases, the operation of the unit 10 can be monitored by bringing the unit into proximity with an appropriate sensor/reader. The reader can pick up data and operating information from the device accordingly.

Once programmed to operate, microprocessor 110 drives an amplifier or other electrical energy driver 140 at a determined rate. Driver 140 may be an amplifier that receives a driving signal from microprocessor 110 and amplifies the signal to drive a transducer (e.g., a piezoelectric crystal) 150 accordingly. The transducer 150 then vibrates or generates mechanical or acoustical oscillations. In some embodiments, the transducer 150 is mechanically coupled or fixed to a solid substrate 160 that better transmits the energy from transducer 150 into the underlying proximal scar tissue 180. The transmission of vibratory energy from the transducer 150 and solid substrate 160 may in some embodiments be enhanced by application of a transmission gel 170 that better couples the device 10 to the tissue 180. The transmission gel may be medicated with balms or medicinal substances intended for topical application to the affected tissue 180, and in some embodiments, may also be designed for penetration into or through the dermis of the patient to achieve a deeper effect.

In some embodiments, very fine spikes 165 are fixed to the solid substrate 160. Spikes 165 can act to mechanically anchor and secure the device 10 to the patient's tissue, but are fine enough not to cause pain or bleeding. Also, the spikes can act to transmit the vibratory energy from the transducer 150 and solid substrate 160 to regions deeper than the surface of tissue 180. In addition, the spikes can act to allow better introduction of medicated liquids or gels or topical applications of medicinal agents into the tissue 180.

A second LED 195 may be controlled by microprocessor 110 to indicate certain conditions to the user. In one example, LED 195 is illuminated when transducer 150 is powered. In another example, the LED is illuminated to indicate a fault condition in the circuitry of the device 10. In yet another example, the LED 195 is made to blink at a rate corresponding to a state of operation of the device 10. In still another example, LED 195 indicates a communication state, for example, indicative of a connection status of the device 10.

As mentioned, one aspect of the present system and method is application of surface vibratory, abrasive and/or mechanical relative motion between a surface of the apparatus and the surface of the skin at the area to be treated. The gentle repetitive scraping and massaging and exfoliating actions made possible thereby can be programmably and suitably adapted for many applications and ailments and situations. In some embodiments, a direction of relative motion between the vibrating applicator and the underlying skin is determined for the given context in which it is used. In other aspects, the apparatus may be made to apply a plurality of types of vibratory motion with respect to the skin as will be described below. Circulation in the skin tissue proximal to the abrasive or massaging or rubbing action as well as improved oxygen delivery to the same can accelerate healing and have other beneficial effects.

Figure 2:
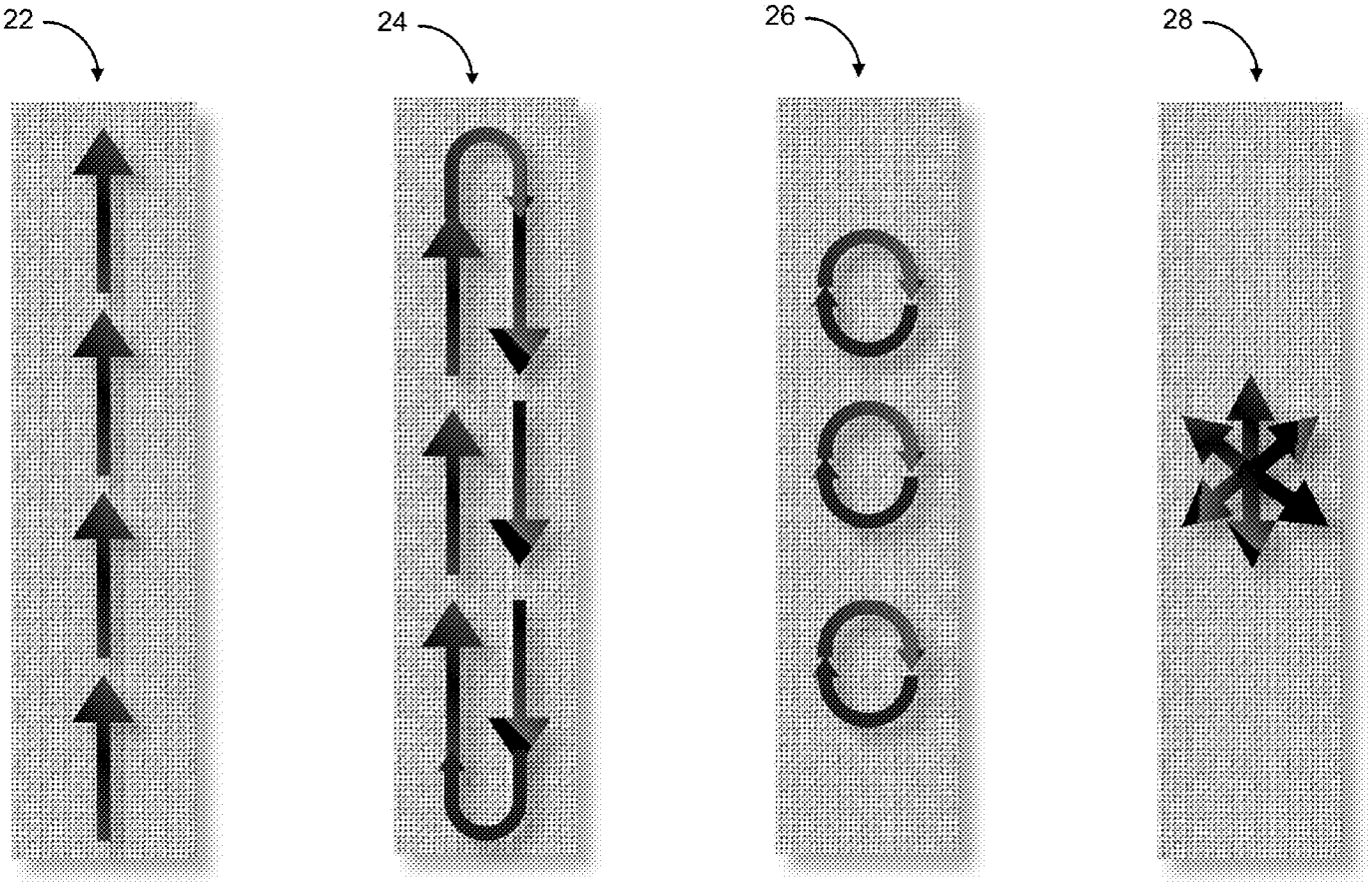
FIG. 2 illustrates some exemplary modes of movement of the surface against the skin.

FIG. 2 illustrates a number of exemplary ways of applying vibrational or relative motion between the vibrating apparatus and the skin. In example 22, the abrasive surface is made to provide unidirectional undulating movement with respect to the skin. In practice this may be provided by micromechanical elements in the abrasive surface or in a layer attached to the abrasive surface. Alternatively, mechanical rollers or piezo electric synchros may provide the rolling or stretching motion of the abrasive surface so that it rubs the skin or a scar along a preferred direction. The preferred direction may be for example along an axis of the abrasive surface device, which may be configured like a bandage having a central portion of its face proximal to the skin that is not adhesive but instead allows rubbing, massaging, scraping, exfoliating, or vibrating of the collagen and tough fibers of a scar. The motion according to example 22 may be applied cross-wise or perpendicular to a direction of the scar or collagen fibers.

In the same figure, example 24 illustrates an embodiment whereby the undulation or substantially linear wiping movement of the abrasive surface goes back and forth as indicated by the arrows, such that there is an axial effect to the rubbing motion but it is equally applied in a forward and a backward direction.

In example 26 of the same figure, a substantially circular movement about a central axis perpendicular to the plane of the abrasive surface and the skin surface occurs. The bandage-like applicator has optionally some adhesive edges but a central portion that is not adhered to the skin and that can provide relative motion between the abrasive surface and the skin to rub the skin along the circular pattern or patterns. Again, micro electro-mechanical elements or piezo layers may be used to cause the present motion. Also, small motors or mechanical rollers can also be coupled to a layer near the abrasive layer so as to transmit the mechanical movement thereof to the surface of the affected skin.

In example 28 of the same figure the movement of the abrasive surface is radially applied along a plurality of directions with respect to a center of the motion.

Note that an apparatus can be programmed or controlled by software instructions and/or a microprocessor having embedded or stored commands to cause the apparatus to switch between one or more of the above movement types as well as many others that would occur to one skilled in the art. It can cycle through several motion types, dwelling on each a determined period of time.

Still optionally, the apparatus may include a sensor. The sensor can sense some environmental or biological parameter. The sensor provides a signal indicative of the detected parameter. This signal can then be used by a controller or microprocessor logic to decide when to activate, stop, or switch the mode or operation or the intensity of the vibratory movement of the motion driver in the apparatus. So, as mentioned before, the device can switch on, off, or between one or more states based on a dwell time or duty cycle program. Also, the device can sense a temperature, pulse rate, perfusion level, oxygen level, perspiration activity or other parameter to cause the above state changes to the operation of the apparatus.

Figure 3:
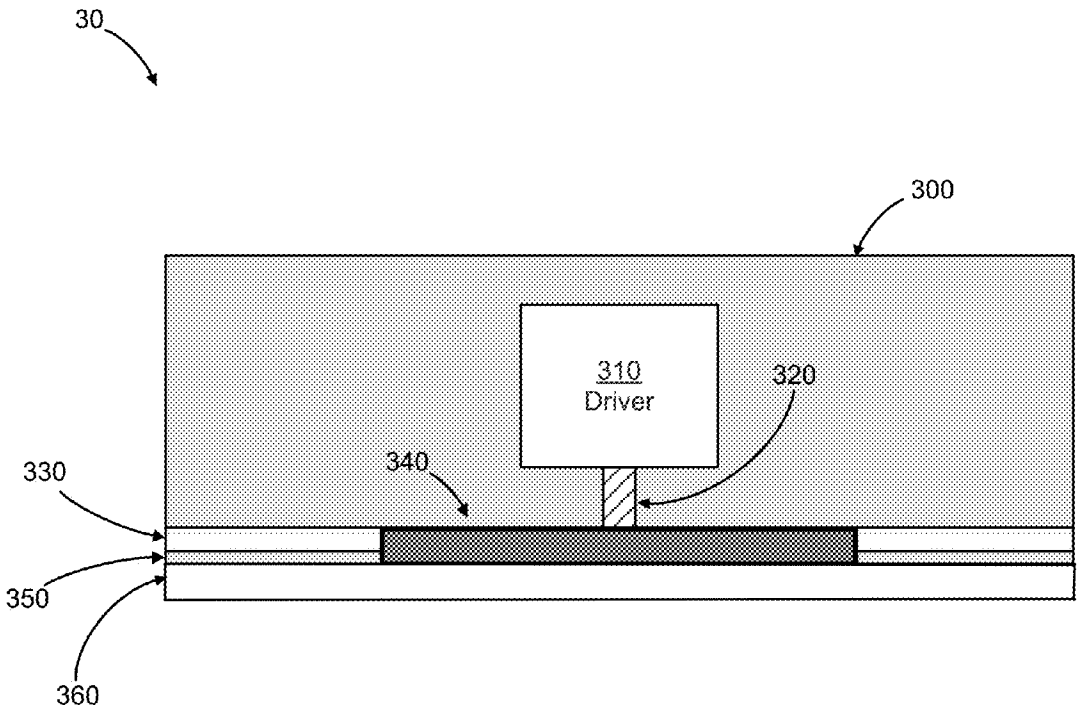
FIG. 3 illustrates an exemplary apparatus with prime mover for scar revision and other beneficial dermatological effects.

FIG. 3 illustrates an exemplary cross section of a vibrating apparatus 30 for treating a dermatological condition. The apparatus is generally contained in a housing or strip (here not drawn to scale for clarity) or package 300. A driver or vibrator 310, which can be a piezo element, small motor, or other repetitive vibrating component, vibrates or oscillates when driven by an electric power source. The electric power may be derived from a battery or electrical coupling or may be solar-powered by way of a small solar (light) collecting panel at the top surface of housing or package 300.

Mechanical energy is transmitted from driver 310 through a support post or rigid member 320 to abrasive layer 340, said support post 320 being mechanically coupled to both the vibratory driver 310 as well as the abrasive layer 340 on a first face (e.g. an upper face) thereof. A second (e.g. a lower face) of abrasive layer 340 is applied to a patient's skin 360 without gluing, fixing, adhering or otherwise sticking abrasive layer 340 to skin 360, but rather, abrasive layer 340 is allowed to rub and scratch and abrade the skin 360 according to the movement supplied by driver 310 and support post 320.

A semi-rigid layer 330 may surround abrasive layer 340. Also, a sticky or adhesive layer 350 can separate a portion of the device 30 and the skin 360 and allow adhesion of the device 30 to the skin 360 while still allowing the abrasive layer 340 to move with respect to the skin 360. That is, a central portion of the apparatus proximal to the skin can be allowed to dry or wet abrade the skin while the device as a whole is secured to or taped to the skin at portions that are proximal to the skin but generally outside the abrasive treatment zone.

Figure 4:
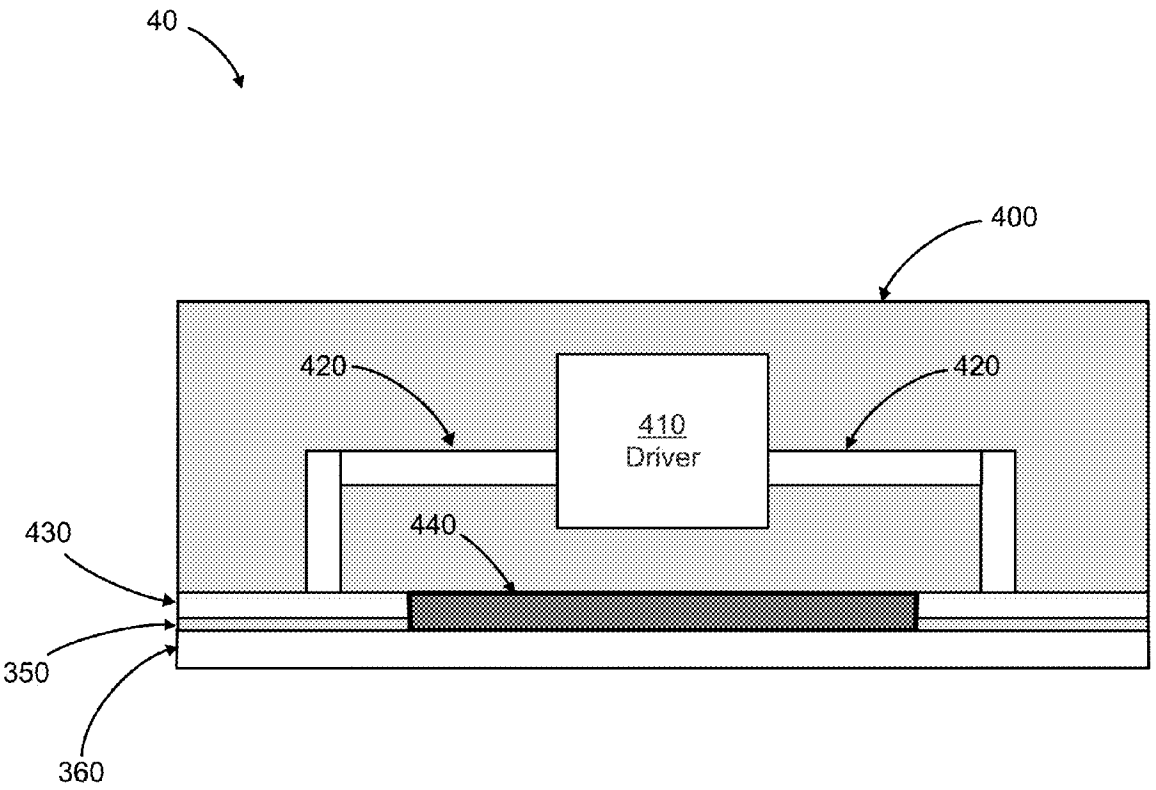
FIG. 4 illustrates another exemplary apparatus with prime mover for scar revision and other beneficial dermatological effects.

FIG. 4 illustrates yet another exemplary embodiment in cross section. The apparatus 40 includes a housing or package 400 (not drawn to scale for clarity). Inside housing or packaging 400 resides a vibrating powered element 410 similar to those described above. The abrasive layer 440 is not directly coupled to or driven by the driver 410. But instead, the movement of the driver 410 is transmitted through posts or couplings 420 to a rigid or semi-rigid layer 430. Since layer 430 is mechanically coupled to the abrasive layer 440.

In either, both or other similar embodiments, cosmetic or medicinal agents or lotions or drugs may be placed between the most proximal surface of apparatus 30, 40 and the skin being treated. The substances between apparatus 30, 40 and the skin may be topical agents to assist in scar remediation or other skin condition treatment as known to those skilled in the art.

Those skilled in the art would also appreciate that programming the device 10 to vibrate at preferred frequency and intensity and cycles can assist in scar revision. For example, the device can operate continuously at a resonance frequency of transducer 150. Alternatively, the device can vibrate with a given duty cycle (ON-OFF or ON-OFF-OFF etc.) as needed. This can save battery life and prolong the time the treatment can go on before a battery needs replacement. Also, it may be optimal for the scar revision to allow the tissue to be quiescent for some time between applications of the vibratory action. The intensity of the vibration can also be modulated according to a program by application of varying power by driver 140. In some embodiments, the vibratory action is centered about a given center frequency determined to enhance scar revision.

Figure 5:
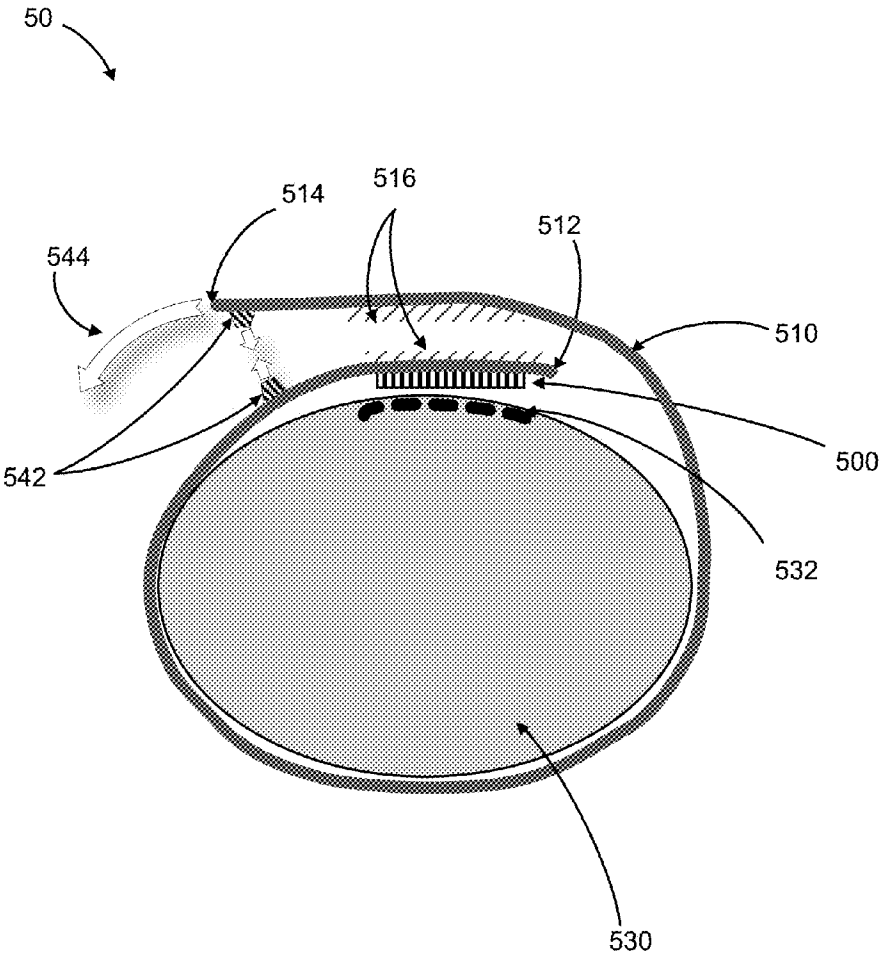
FIG. 5 illustrates a band wrappable about a limb or organ for securing a scar revision device to an area of the skin having a wound or scar.

FIG. 5 illustrates an apparatus 50 for wound treatment or scar revision according to some embodiments. A patient's body or a limb for example is shown in cross section 530. For example, the apparatus or device 50 is to be applied to a patient's forearm to treat a wound or apply scar revision thereto. A scar 532 is depicted graphically at some location on the surface of the body part 530. The active frictional or vibrating element 500 may be similar to those described above.

In an aspect, the frictional or vibrating element 500 is part of or secured to a band 510. The band 510 may be elastic (stretchable) to apply pressure around the body 530 in an embodiment, e.g., made of a medical type of elastic fabric material. The band 510 may also be not stretchable in other embodiments, e.g., made of plastic, leather, fabric or other suitable material. The band 510 is wrapped about the patient (or his or her limb in the above example) 530. The band 510 may be secured by any of a number of appropriate methods of securing the band 510 about the patient 530. For example, hook-and-loop fasteners 516 can be provided on proximal faces of band 510 near a first end 512 and a second end 514 thereof. Alternately, or in addition, a snap, rivet, magnetic or mechanical latch, or other similar mating pair of fasteners 542 may be provided to so secure the band 510 about the patient 530. Belt buckles, zipper ties and other fastening methods are also contemplated hereby, but not limited to those given here by way of example.

The band 510 is applied so that the active frictional or vibrating element 500 is positioned over the skin at the location of the scar 532 to be treated. The band 510 is tightened as shown by 544 to an appropriate firmness about the patient 530. The device 50 is then operated as described above to treat the wound or scar.

Note that the band 510 does not necessarily need to circumferentially extend all the way around the patient 530 in some embodiments, but may be clamped around a portion of the patient's anatomy (like a bracelet) using flexible members that secure the active vibrating element 500 in place with respect to the scar 532.

The examples described and shown are exemplary. These and other features and alternatives would now be apparent to those skilled in the art and are comprehended hereby so that the scope of the present disclosure is not limited to the illustrative embodiments described and explicitly shown.

What is claimed is:

1. An apparatus for treating a damaged area of skin, comprising:

a housing;

a coupling disposed inside said housing, said coupling including first and second posts;

a power source disposed in said housing;

an abrasive layer disposed along an exposed edge of said housing, said abrasive layer having an exposed surface;

a rigid or semi-rigid layer in communication with said coupling, said rigid or semi-rigid layer defining a gap between first and second portions of said rigid or semi-rigid layer, said abrasive layer disposed in said gap and in direct physical contact with said first and second portions of said rigid or semi-rigid layer;

an electro-mechanical driver driven by electrical energy from said power source and indirectly transmitting vibratory mechanical energy to said abrasive layer via said first and second posts of said coupling, said first and second posts in direct physical contact with said first and second portions, respectively, of said rigid or semi-rigid layer and directly mechanically coupled to said driver, said vibratory mechanical energy for applying relative vibratory or repetitive movement between said abrasive layer and said damaged area of skin; and an adhesive layer disposed proximal to said abrasive layer on an exposed edge of each of said first and second portions of said rigid or semi-rigid layer, said adhesive layer for adhering to a portion of a patient's skin proximal to said damaged area.

2. The apparatus of claim 1, further comprising a microprocessor that controls delivery of said electrical energy to said transducer.

3. The apparatus of claim 2, further comprising a memory storage unit that stores any of: program instructions for execution on said microprocessor or accumulated operational data of said apparatus.

4. The apparatus of claim 2, further comprising a data interface for exchanging data with an external computer.

5. The apparatus of claim 1, further comprising at least one indicator that indicates an operating condition of said apparatus.

6. The apparatus of claim 1, further comprising a solid substrate coupled to said transducer for transmitting vibratory energy from said transducer to a location of a scar.

7. The apparatus of claim 6, further comprising micro-spikes coupled to said solid substrate and operable to embed a portion of said micro-spikes into a tissue of said scar.

8. The apparatus of claim 1, further comprising a micro electro mechanical system (MEMS) based device for affecting said relative vibratory or repetitive movement between said abrasive layer and said skin.

9. The apparatus of claim 1, further comprising at least one sensor that senses an environmental or operational or biological parameter and delivers an output signal indicative of said parameter, said output signal being used in turn as an input by said microprocessor in controlling said driver.

10. The apparatus of claim 1, further comprising a band extending circumferentially about an anatomy of a patient to position said abrasive layer over said damaged skin.

11. The apparatus of claim 10, said band comprising an elastic band for applying elastic pressure so as to press the apparatus to the patient's damaged skin.

12. The apparatus of claim 10, further comprising corresponding mating fastener elements, one proximal to each of two opposing ends of said band once it is wrapped around said anatomy.

* * * * *